United States Patent [19]

Racca

[11] 4,108,314

[45] Aug. 22, 1978

[54] APPARATUS FOR STORING TOILETRIES IN A SHOWER

[76] Inventor: Enrico R. Racca, 23 Meadow St., Brooklyn, N.Y. 11206

[21] Appl. No.: 844,523

[22] Filed: Oct. 25, 1977

[51] Int. Cl.[2] ..... A47K 5/00

[52] U.S. Cl. ..... 211/74; 211/113; 248/212

[58] Field of Search ..... 211/74, 71, 113–119, 211/76, 84; 248/309–315, 317, 318, 328–331, 212–215, 108; 222/179.5, 180, 181

[56] References Cited

U.S. PATENT DOCUMENTS

| | | | |
|---|---|---|---|
| 2,838,209 | 6/1958 | Legman | 248/328 X |
| 3,166,281 | 1/1965 | Maro | 248/108 |

FOREIGN PATENT DOCUMENTS

| | | | |
|---|---|---|---|
| 156,075 | 10/1932 | Switzerland | 248/212 |
| 386,070 | 3/1965 | Switzerland | 248/212 |

*Primary Examiner*—William H. Schultz
*Assistant Examiner*—Terrell P. Lewis
*Attorney, Agent, or Firm*—Anthony J. Casella; Joseph A. Calvaruso

[57] ABSTRACT

An apparatus for storing toiletries in a shower comprises an elongated mounted member which is secured to the plumbing element of the shower. The apparatus further includes a bottle carrier having a central aperture for receiving the neck of a toiletry bottle. The aperture has a diameter greater than the diameter of the bottle neck but less than the exterior diameter of the bottle cap. The carrier is secured to the bottle by placing the bottle over the bottle neck and then screwing the bottle cap onto the bottle neck. The subject apparatus further includes means interconnecting the bottle carrier with the mounting member such that the toiletry bottle hangs close to the shower wall adjacent the shower element.

12 Claims, 6 Drawing Figures

APPARATUS FOR STORING TOILETRIES IN A SHOWER

BACKGROUND OF THE INVENTION

The subject invention relates to an apparatus for carrying or mounting toiletries in a shower so that said toiletries may be easily and conveniently reached by one taking a shower. There are known devices, commonly referred to as "caddies," which attempt to provide the stated function. However, in practice, said known devices have been found to have several shortcomings. In essence, known "caddies" consist of an open cabinet like device which is mounted in the shower and includes a plurality of shelves for carrying toiletries. While these "caddies" enable the toiletries to be conveniently located and within easy reach, it has been found, that if the person taking a shower is not careful, accidents can easily occur. For example, because the toiletries are not secured to the "caddie" they can be easily knocked over by one taking a shower. If the cap of the toiletry container is not tightly closed the contents thereof spills and wastefully flows down the drain. In addition to the spillage of material, and more importantly, the fact that the toiletries are not secured to the "caddie" makes a person taking a shower vulnerable to the possibility of a container falling on his bare foot. It will be appreciated that if the container is full it can be relatively heavy and thus can cause an injury.

Accordingly, it is an object of the subject invention to provide an apparatus for storing toiletries within a shower in which the toiletry containers are fixed to the apparatus so as to prevent accidental knocking over of the containers.

It is a further object of the subject invention to provide an apparatus having the above characteristics which is lightweight, easy to mount and remove, and which keeps the toiletry containers within reach but out of the way of a person taking a shower.

SUMMARY OF THE INVENTION

In accordance with the subject invention an apparatus for storing toiletries such as shampoo within a shower comprises an elongated mounting member which is affixed to the plumbing element of the shower. Preferably the mounting element is of a two part construction each part being the mirror image of the other. In addition, it is preferable that each mounting member part includes a C-shaped center portion for receiving the plumbing element of the shower. The two parts may be held in a clamped position around the plumbing element by any means such as screws, nuts and bolts, or a suitable adhesive.

The apparatus further comprises a shoulder or container carrying member. The apparatus includes one carrier member for each container to be carried. Preferably, the carrier member conforms in contour to the top surface of a toiletry container and includes a central aperture for receiving the neck of the container. The diameter of said central aperture must be greater than the diameter of the neck of the container, but less than the exterior diameter of the cap of the container. In the preferred embodiment of the subject invention the shoulder member further includes a pair of spaced, raised cylindrical members, each cylinder being on an opposite side of the central aperture.

The subject apparatus further comprises means for interconnecting the mounting member with each carrier member. Preferably, said interconnecting means comprises string means having one end affixed to the mounting member and the other end thereof affixed to the carrier member supporting a container. The string means may be threaded through the cylinder members of the carrier member and knotted so as to securely fix the string means to the carrier and container carried thereby. In addition, the string means may be waxed or made water resistant so as to maintain its strength despite its contact with water and soap.

In operation the toiletry containers hang from the mounting member of the subject apparatus which is mounted on the plumbing element of the shower between the shower wall and the shower head. Thus they are disposed adjacent to the shower wall and out of the way of a person taking a shower. When the person desires to use a particular toiletry he merely reaches for the container, applies the toiletry, and then releases the container where it will return to its normal position adjacent the shower wall. Because the containers are fixed to the subject apparatus there is no danger of knocking over a container.

In an alternate embodiment of the subject invention the mounting member may be constructed such that the distal ends thereof can pivot away from or towards the shower wall.

DESCRIPTION OF THE PREFERRED EMBODIMENTS

Figure 1:
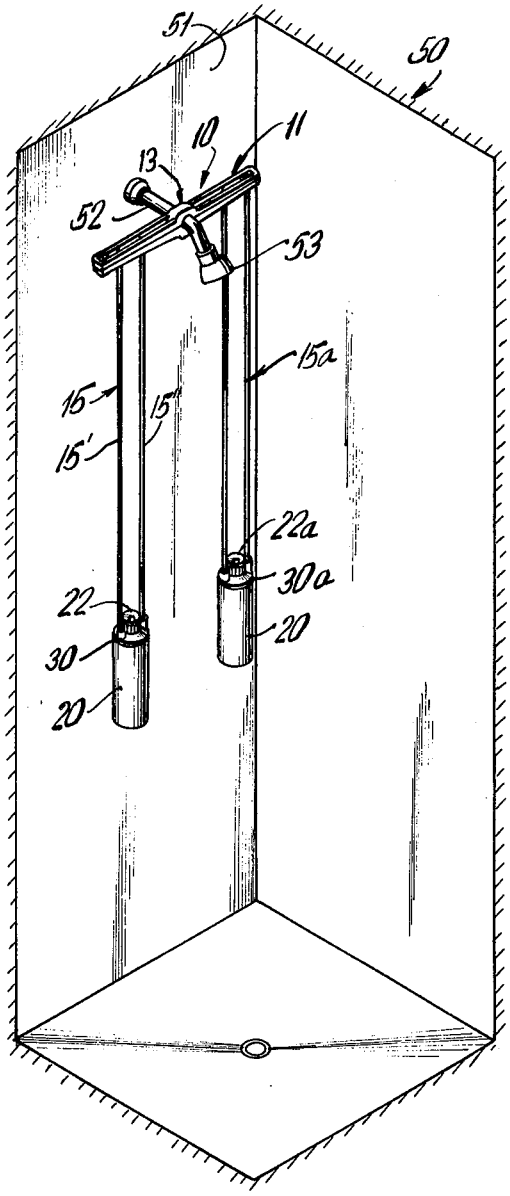
FIG. 1 is a perspective view of a shower stall in which the apparatus of the subject invention has been installed.

Referring to FIG. 1 the toiletry carrier 10 of the subject invention is illustrated as mounted in a shower stall 50 wherein toiletry containers 20 and **20*a* carried thereby are stored within easy reach of a person taking a shower. Preferably the subject apparatus is mounted on the shower plumbing element 52, and is disposed intermediate shower wall 51 and shower head 53. Containers 20, 20*a* are typical bottles commonly used to hold toiletries, and may be filled with shampoo, hair rinse, bath oil, etc. Preferably, the bottles are made from a non-breakable material, and are closed by a cap member 22 which includes a dispensing spout 23. In this way there is no need to remove the cap in order to apply the toiletry. While containers 20, 20*a*** are illustrated as being cylindrical it will be understood that they can take any desired shape.

Referring to FIGS. 2-5 the various portions of the subject apparatus are shown in detail. It should be noted that for the sake of simplicity said Figures merely illustrate the detailed structure of the subject apparatus with respect to its carrying of one toiletry container (20). The structure of the subject apparatus relative to the carrying of container 20*a* or any other container is identical.

Figure 2:
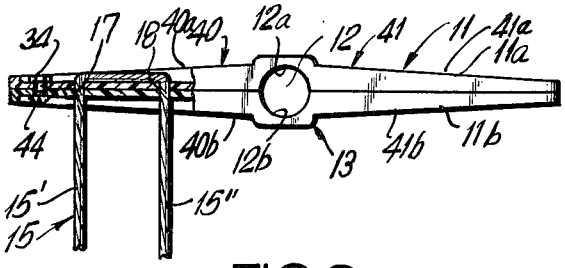
FIG. 2 is an elevational view sectioned in part, of the mounting member of the subject apparatus.

Referring specifically to FIG. 2 the subject apparatus includes an elongated mounting member 11 for affixing the apparatus to the shower plumbing element. Mounting member 11 includes a central body portion 13 having an aperture 12 for receiving the shower plumbing element. In addition mounting member 11 includes a pair of elongated arm members 40 and 41 from which the toiletry bottles hang. Preferably, mounting member 11 is of two part construction and includes clamp portions 11*a* and 11*b* which are mirror images of each other. Each clamp portion 11*a* and 11*b* includes a central C-shaped channel or groove portion, 12*a* and 12*b*, respectively, which, when the clamp members are secured to each other, form body portion 13 and aperture 12 for receiving the shower plumbing element. In addition, each clamp member 11*a* and 11*b* includes a pair of arm members 40*a* and 41*a*, and 40*b* and 41*b* respectively. As illustrated in the Figures, clamp portions 11*a*, 11*b* are secured to each other by means of nuts 34, 34*a* and bolts 44, 44*a*. Said clamp portions may also be secured by other means such as male and female snap means, or a suitable adhesive where permanent mounting of the apparatus is desired.

Figure 5:
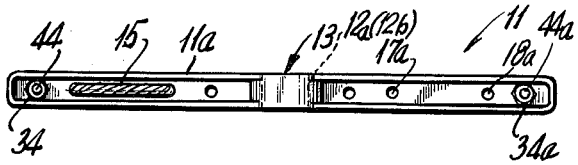
FIG. 5 is a top plan view of the mounting member of the subject apparatus.

Further referring to FIG. 2 in conjunction with FIG. 1 the subject apparatus includes a string element 15 which provides interconnecting means between mounting member 11 and bottle 20. Preferably, string 15 is waxed or in some other way made water resistant so as to remain durable for prolonged use in a shower. As illustrated in the Figures string 15 is threaded through spaced apertures 17 and 18 of mounting member 11 thus forming two spaced connecting means 15' and 15''. As shown in FIG. 5 apertures 17*a* and 18*a* are provided for string element 15*a* of FIG. 1. Of course instead of having one string as illustrated in the subject drawing it is also possible to have two separate strings an end of each string being secured to mounting member 11.

Figure 3:
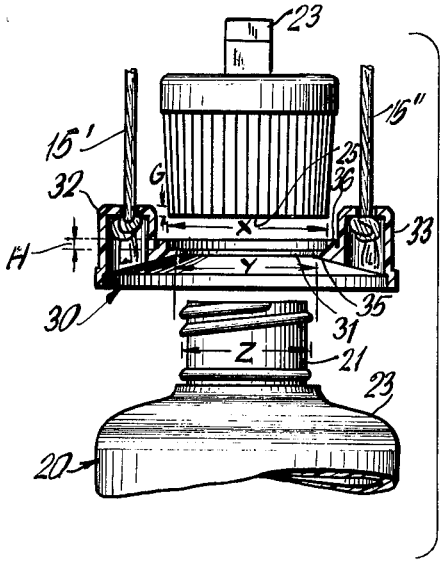
FIG. 3 is an exploded elevational view sectioned in part of the container carrying portion of the subject apparatus.
Figure 4:
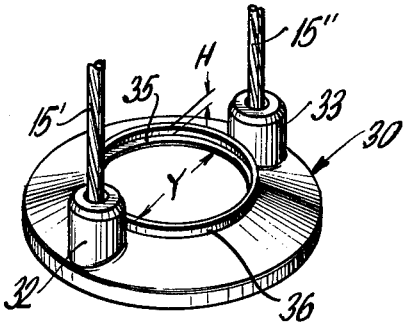
FIG. 4 is a perspective view of the container carrying portion of the subject apparatus.

Referring to FIGS. 3 and 4 the subject apparatus further includes a carrier member 30 which preferably has a configuration which conforms to the contour of the top surface or shoulder 23 of bottle 20. Carrier member 30 has a central aperture 31 for receiving neck 21 of bottle 20. Around said aperture 31 is a raised ring portion 36 which is concentric with aperture 31, but has a greater diameter than said aperture. Preferably, ring portion 36 has a height H such that the bottom portion G and edge 25 of cap member 22 are enclosed by said ring portion. The portion of the carrier member 30 disposed between aperture 31, and ring 36 forms an annular lip 35 the function of which will be described below. Carrier member 30 further includes means for securing the ends of string element 15. More particularly, carrier 30 includes a pair of spaced raised cylindrical members 32 and 33 each cylinder being disposed on opposite sides of ring portion 36. As illustrated in the drawings the ends of string 15 are secured to carrier 30 by threading said ends through the respective cylinders, and knotting the ends so that they cannot repass through the cylinders.

Referring to FIGS. 3 and 4 in conjunction with FIG. 1 there is illustrated the specific relationships between the carrier member structure and that of the bottle to be carried. More particularly as shown in the Figures the diameter "Y" of carrier aperture 31 is greater than diameter "Z" of bottle neck 21. In addition, said diameter "Y" is less than the exterior diameter "X" of the bottle cap member 22. Thus, carrier 30 is mounted over bottle neck 21 and onto the top surface 23 of the bottle. Then, cap member 22, is screwed onto neck 21 thus securing carrier member 30 to the bottle. The lip 35 of the carrier cooperates with the bottom edge 25 of the cap member to prevent removal of the carrier as well as to support and carry the bottle 20.

Figure 6:
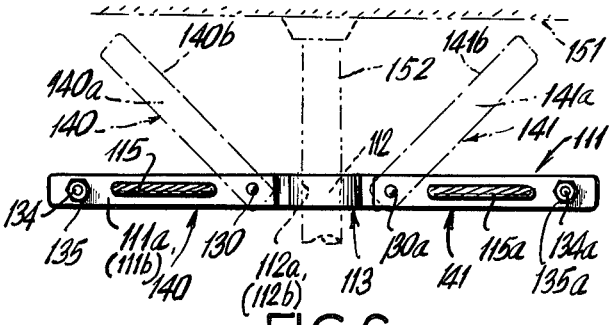
FIG. 6 is a top plan view of an alternate embodiment of the mounting member of the subject invention.

Referring to FIG. 6 there is illustrated an alternate embodiment of the subject apparatus. In said alternate embodiment mounting member 111 includes a central body portion 113 having an aperture 112 for receiving the shower plumbing element 152. In addition, mounting member 11 includes a pair of elongated arm members 140 and 141 which are pivotally connected to body portion 113 by means of pins 130 and 130*a* respectively. Thus, toiletry bottles carried by the subject apparatus can be placed closer or farther away from the shower wall as desired. Preferably, mounting element is of two part construction comprising clamping members 111*a* and 111*b* which are mirror images of each other and are secured to each other by means of nuts 134, 134*a* and bolts 135, 135*a*. Clamping member 111*a* includes a central substantially C-shaped groove portion 112*a* having arm members 140*a* and 141*a* pivotally connected to either side thereof. Similarly clamping member 111*b* includes a central C-shaped groove portion 112*b* having arm members 140*b* and 141*b* pivotally connected to either side thereof. When clamping members 111*a* and 111*b* are secured to each other groove portions 112*a* and 112*b* combine to form body portion 113 having aperture 112 for receiving the shower plumbing element.

In summary, the subject invention provides an apparatus for storing toiletry bottles within a shower so as to be easily accessible to a person taking a shower. The toiletry bottles hang closely adjacent to the shower wall, and because they are fixed to the subject apparatus the problems existing with known "caddies" such as accidental spillages and possible bodily injury are virtually eliminated. In use, a person taking a shower merely reaches for a bottle, applies the toiletry, and then lets go of the bottle which automatically returns to its normal position adjacent to the shower wall.

While the preferred embodiment of the subject invention has been described and illustrated, it would be obvious that various changes and modifications can be made therein without departing from the spirit of the invention which should be limited only by the scope of the appended claims.

What is claimed is:

1. An apparatus for storing toiletry bottles within a shower said bottles having a removable screw on cap member comprising:

a mounting member for attaching the apparatus to the plumbing element of the shower, said mounting member being of two part construction including two clamping members, each clamping member being the mirror image of the other, each clamping member including a substantially C-shaped groove portion which when the clamping members are secured to each other form an aperture for receiving the shower plumbing element;

means for securing said mounting member to the plumbing element of the shower;

a bottle carrier having a central aperture for receiving the neck of one of the toiletry bottles, said aperture having a diameter greater than the exterior diameter of the bottle neck but lesser than the exterior diameter of the bottle cap such that the carrier can be mounted over the bottle neck and secured to the bottle when the bottle cap is screwed onto the bottle neck; and means for interconnecting the bottle carrier with the mounting member such that the bottle hangs adjacent the shower wall.

2. An apparatus for storing toiletry bottles within a shower as recited in claim 1 in which the toiletry bottles are unbreakable.

3. An apparatus for storing toiletry bottles within a shower as recited in claim 1 in which the carrier member is configured so as to conform to the shape of the shoulder of the bottle to be carried.

4. An apparatus for storing toiletry bottles within a shower as recited in claim 1 in which the mounting member is releasably attached to the plumbing element of the shower.

5. An apparatus for storing toiletry bottles within a shower as recited in claim 1 in which clamping members are secured to each other by means of nuts and bolts.

6. An apparatus for storing toiletry bottles within a shower as recited in claim 1 by suitable adhesive.

7. An apparatus for storing unbreakable toiletry bottles in a shower said bottles having a removable screw on cap member, said apparatus comprising:

an elongated mounting member for attaching the apparatus to the plumbing element of the shower, said mounting member having a two part construction including a pair of clamping members, each of said clamping members being the mirror image of the other, each of said clamping members having a central enlarged substantially C-shaped groove portion which when said clamping members are secured to each other form an aperture for receiving the plumbing element of the shower;

means for securing said clamping members to each other and around the shower plumbing element;

a bottle carrier having a configuration substantially conforming to the configuration of the shoulder of the bottle to be carried, said carrier having a central aperture for receiving the neck of the bottle to be carried, said aperture having a diameter greater than the diameter of the bottle neck but lesser than the exterior diameter of the bottle cap such that the carrier can be mounted over the bottle neck and be secured to the bottle when the bottle cap is screwed onto the bottle cap, said carrier further including a raised ring portion concentric with said receiving aperture but having a greater diameter than said receiving aperture such that the portion of the carrier disposed between said aperture and said ring portion forms an annular lip for supporting the bottle cap member when it is screwed onto the bottle neck; said carrier further including a pair of spaced cylindrical members each cylindrical member being disposed on opposite sides of said ring portion; and a string element for interconnecting said mounting member with said bottle carrier, said string member being threaded through a pair of spaced through apertures in said mounting member and each end of said string element being threaded through one of the cylindrical members of the carrier and knotted such that said ends cannot repass through the cylinders.

8. An apparatus for storing unbreakable toiletry bottles in a shower as recited in claim 7 in which the string element is water resistant.

9. An apparatus for storing toiletry bottles within a shower, said bottles having a removable screw on cap member, said apparatus comprising:

an elongated mounting member for attaching the apparatus to the plumbing element of the shower, said mounting element including a central enlarged portion having an aperture for receiving said shower plumbing element and a pair of arm members pivotally connected to said central receiving portion;

means for affixing said mounting member to the plumbing element of the shower;

a bottle carrier having a central aperture for receiving the neck of the toiletry bottles, said aperture having a diameter greater than the exterior diameter of the bottle neck but lesser than the exterior diameter of the bottle cap, such that the carrier can be mounted over the bottle neck and secured to the bottle when the bottle cap is screwed onto the bottle neck; and means for interconnecting the bottle carrier with the arm members of the mounting member such that the bottles hang adjacent to the shower wall and can be placed at varying distances from said shower wall.

10. An apparatus for storing unbreakable toiletry bottles in a shower said bottles having a removable screw on cap member, said apparatus comprising:

an elongated mounting member for attaching the apparatus to the plumbing element of the shower, said mounting member having a two part construction including a pair of clamping members, each of said clamping members being a mirror image of the other, each of said clamping members having a central body portion having a substantially C-shaped groove which when said clamping members are secured to each other form an aperture for receiving the plumbing element of the shower, each of said clamping members further including a pair of pivot arm members each being pivotally connected to the central body portion;

means for securing said clamping members to each other and around the shower plumbing element;

a bottle carrier having a configuration substantially conforming to the configuration of the shoulder of the bottle to be carried, said carrier having a central aperture for receiving the neck of the bottle to be carried, said aperture having a diameter greater than the diameter of the bottle neck but lesser than the exterior diameter of the bottle cap such that the carrier can be mounted over the bottle neck and be secured to the bottle when the bottle cap is screwed onto the bottle cap, said carrier further including a raised ring portion concentric with said receiving aperture but having a greater diameter than said receiving aperture such that the portion of the carrier disposed between said aperture and said ring portion forms an annular lip for supporting the bottle cap member when it is screwed onto the bottle neck; said carrier further including a pair of spaced cylindrical members each cylindrical member being disposed on opposite sides of said ring portion; and a string element for interconnecting said mounting member with said bottle carrier, said string member being threaded through a pair of spaced through apertures in said mounting member and each end of said string element being threaded through one of the cylindrical members of the carrier and knotted such that said ends cannot repass through the cylinders.

11. An apparatus for storing unbreakable toiletry bottles in a shower as recited in claim 10 in which the string element is water resistant.

12. An apparatus for storing toiletry bottles within a shower said bottles having a removable screw on cap member comprising:

a mounting member for attaching the apparatus to the plumbing element of the shower;

means for securing said mounting member to the plumbing element of the shower;

a bottle carrier having a central aperture for receiving the neck of one of the toiletry bottles, said aperture having a diameter greater than the exterior diameter of the bottle neck but lesser than the exterior diameter of the bottle cap such that the carrier can be mounted over the bottle neck and secured to the bottle when the bottle cap is screwed onto the bottle neck; and means for interconnecting the bottle carrier with the mounting member such that the bottle hangs adjacent the shower wall, said interconnecting means comprising a pair of spaced string members one end of each string being secured to the mounting member the other end of each string being secured to the carrier member on opposite sides of the central aperture of said carrier member.

* * * * *